US006886966B2

(12) United States Patent
Humphrey

(10) Patent No.: US 6,886,966 B2
(45) Date of Patent: May 3, 2005

(54) COLLAPSIBLE LAMP HARP

(75) Inventor: Neall W. Humphrey, El Dorado Hills, CA (US)

(73) Assignee: Craftmade International, Inc., Coppell, TX (US)

( * ) Notice: Subject to any disclaimer, the term of this patent is extended or adjusted under 35 U.S.C. 154(b) by 278 days.

(21) Appl. No.: 10/235,231

(22) Filed: Sep. 5, 2002

(65) Prior Publication Data

US 2004/0047158 A1 Mar. 11, 2004

(51) Int. Cl.[7] ..... F21V 17/00
(52) U.S. Cl. ..... 362/417; 362/449; 248/170
(58) Field of Search ..... 362/417, 449, 362/358, 414; 248/170

(56) References Cited

U.S. PATENT DOCUMENTS

| | | | | |
|---|---|---|---|---|
| 3,560,733 A | | 2/1971 | Bergman | |
| 3,917,940 A | * | 11/1975 | Duddy | 362/398 |
| 4,096,556 A | | 6/1978 | Berger et al. | |
| 4,851,981 A | | 7/1989 | Ruesch | |
| 5,310,145 A | * | 5/1994 | Chen | 248/170 |
| 5,412,554 A | | 5/1995 | Lee | |
| 6,286,981 B1 | | 9/2001 | McEllen et al. | |

* cited by examiner

*Primary Examiner*—Stephen Husar
*Assistant Examiner*—James Cranson
(74) *Attorney, Agent, or Firm*—Haynes and Boone, LLP

(57) ABSTRACT

A collapsible lamp harp is described.

10 Claims, 3 Drawing Sheets

COLLAPSIBLE LAMP HARP

BACKGROUND

The present disclosure relates generally to a collapsible lamp harp. Lamp harps are typically used for positioning lamp shades within a lighting assembly, such as a lamp.

A lamp harp normally comprises an assembly for engaging a lamp shade and a pair of legs for supporting the shade above the lamp. However, conventional lamp harps have a disproportionately large packaging profile due to the length of the legs.

Thus, what is needed is a lamp harp with a smaller packaging profile than conventional lamp harps. A smaller profile is highly desirable, as it allows for less costly packaging of the lamp harp.

DESCRIPTION

Figure 1:
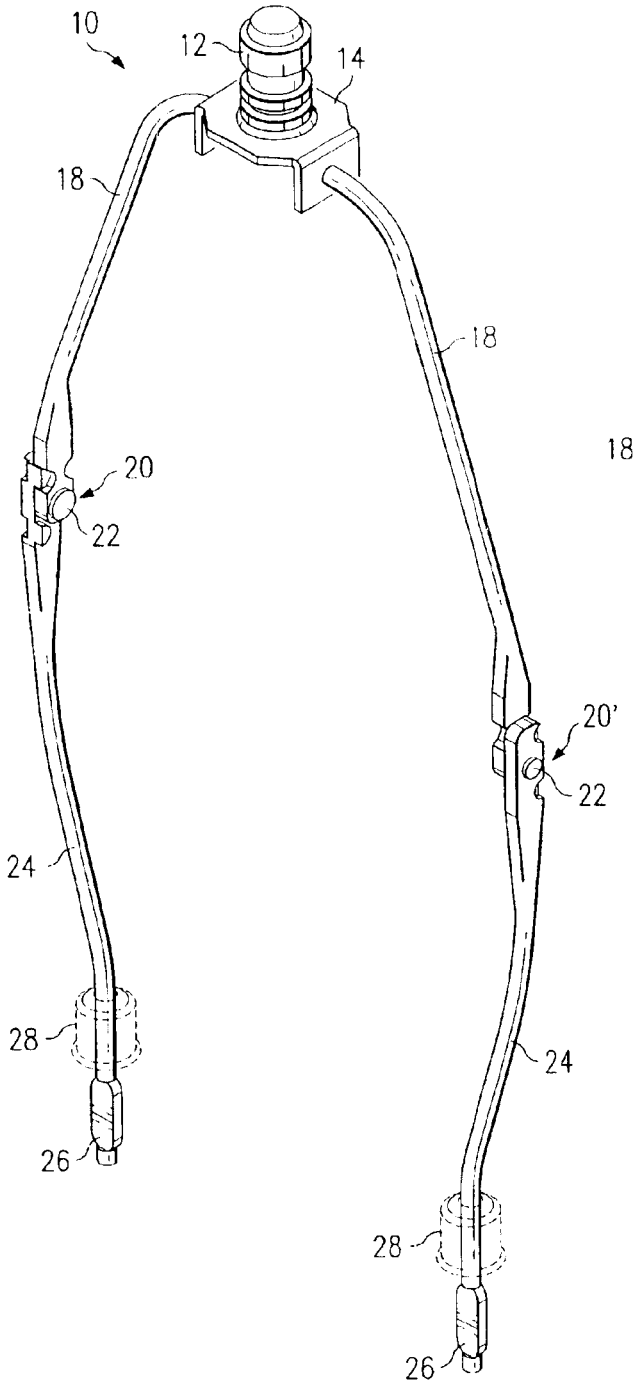
FIG. 1 is a top perspective view of a collapsible lamp harp according to one embodiment of the present disclosure, illustrated in an extended position.
Figure 2:
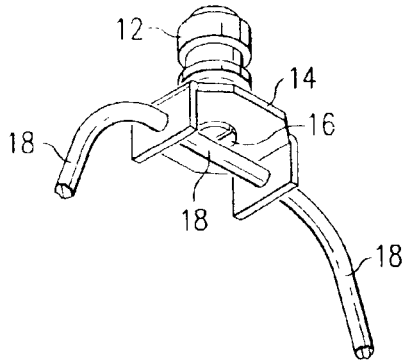
FIG. 2 is a partial bottom perspective view of the collapsible harp.

Referring to FIGS. 1 and 2, a collapsible lamp harp for a conventional lighting assembly (not depicted) according to one embodiment of the present invention is referred to generally by the reference numeral 10. The lamp harp 10 comprises a finial 12 and a platform 14. A screw 16 (FIG. 2) extends through the platform 14 for retaining the finial 12. Together, the finial 12, the platform 14, and the screw 16 cooperate to define an assembly for engaging and retaining a lamp shade (not depicted) in a conventional matter.

A leg 18 extends from the platform 14. Another leg also extends from the platform 14, and is also given the reference numeral 18. It is understood that substantially identical components are given the same reference numerals in this specification. Moreover, in practice, the legs 18 may be formed from one continuous piece.

The distal portion of the leg 18 forms a portion of a connection assembly 20, which will be discussed in greater detail with reference to FIGS. 3*a* and 3*b*. For simplicity of discussion, the opposite connection assembly is given the reference numeral 20', although it is understood that it is substantially similar to, albeit a mirror image of, the connection assembly 20.

A swivel pin 22 connects the leg 18 to a lower leg 24. The lower leg 24 is disposed on the outer side of the leg 18 as depicted. In an alternative embodiment, the lower leg 24 is disposed on the inner side of the leg 18. Regardless, it is necessary that the legs 24 of both connection assemblies 20 and 20' are disposed in the same orientation (i.e., both outer or both inner), in order to form a mirror image.

The leg 24 includes a distal end 26, which is configured to connect to the lamp (not depicted). In an alternative embodiment, the lamp harp 10 comprises a sleeve 28 for covering the distal end 26.

Figure 3A:
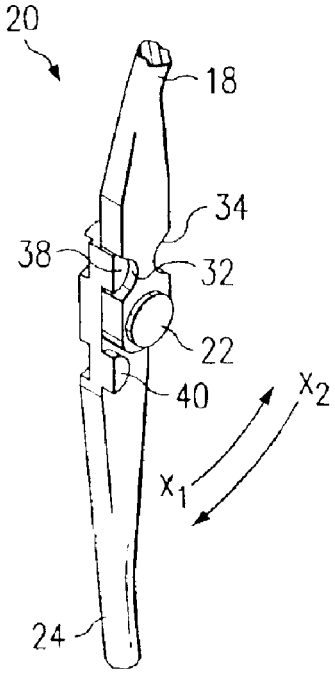
FIG. 3*a* is a partial top perspective view of the connection assembly of the collapsible harp in the extended position.
Figure 3B:
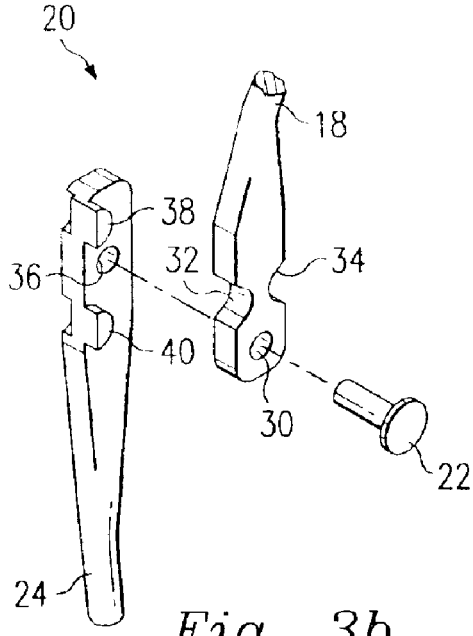
FIG. 3*b* is an exploded view of FIG. 3*a*.
Figure 4:
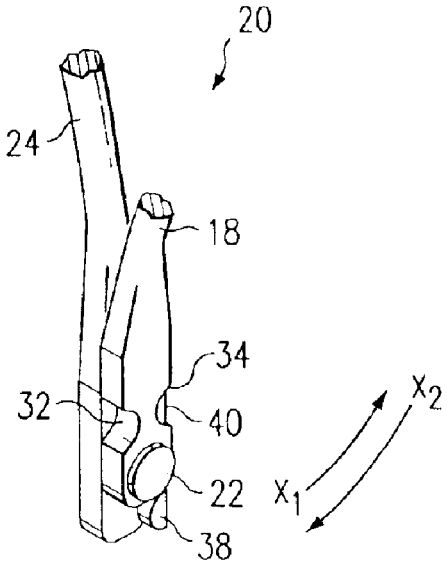
FIG. 4 is a partial top perspective view of the connection assembly in a collapsed position.

Referring now to FIGS. 3*a*, 3*b*, and 4, the connection assembly 20 from FIG. 1 is shown in detail. A bore 30 (FIG. 3*b*) is disposed in the distal end of the leg 18. The leg 18 also includes first and second grooves 32 and 34, located on opposite sides of the leg 18, for reasons to be described.

The bore 30 of the leg 18 is aligned with a bore 36 disposed in the proximal end of the leg 24. The swivel pin 22 passes through the bores 30 and 36, respectively, to secure the legs 18 and 24 to one another. The diameters of the bores 30 and 36 provide enough clearance to allow the legs 18 and 24 to rotate freely with respect to each other. Due to the axis of rotation provided by the swivel pin 22, the legs 18 and 24 may rotate toward each other in a direction depicted by reference arrow $X_1$, or away from each other in a direction depicted by reference arrow $X_2$. The swivel pin 22 may be riveted at its distal end to retain it in place. Also, although a swivel pin is depicted, it is understood that any conventional means may be used to pivotally connect the leg 18 to the leg 24.

The leg 24 also includes first and second catches 38 and 40, located on the same side of the leg 24. As best seen in FIG. 3*a*, when the lamp harp 10 is in its extended position (FIG. 1), the catch 38 is disposed in the groove 32, thereby preventing further rotation in the $X_2$ direction. Likewise, with reference to FIG. 4, when the lamp harp 10 is in its collapsed position, the catch 40 is disposed in the groove 34, thereby preventing further rotation in the $X_1$ direction. In an alternative embodiment, the second catch 40 is omitted.

As noted above, the opposite connection assembly 20' (FIG. 1) is a mirror image of the connection assembly 20 depicted in FIGS. 3*a*, 3*b*, and 4. Thus, the direction of rotation for the opposite connection assembly 20' (not depicted) would be diametrically opposed to the $X_1$ and $X_2$ directions of the connection assembly 20. Therefore, when the lamp harp 10 is in the extended position illustrated in FIG. 1, the catches 38 associated with the connection assemblies 20 and 20' will be on opposite sides of a plane defined by the legs 18, and thus their respective potential $X_1$ rotations will cancel each other out, preventing collapse if the distal ends 26 of the legs 24 are fixed in the lighting assembly (not depicted).

The lamp harp 10 is collapsed from the extended position (FIG. 1) by freeing the distal end 26 of the leg 24 from the lighting assembly (not depicted) and rotating the leg 24 in the $X_1$ direction. The leg 24 rotates until the second catch 40 contacts the second groove 34 to halt rotation of the leg. Once the lamp harp 10 is fully collapsed, it can be placed in a much smaller package than when the lamp harp was fully extended, thereby reducing packaging size and thus shipping costs.

In operation, the lamp harp 10 may be shipped or stored in a collapsed position (FIG. 4). If movement of the lamp harp 10 to the extended position (FIG. 1) is desired, the leg 24 is rotated in the $X_2$ direction until the first catch 38 contacts the first groove 32 to halt rotation of the leg. As explained above, because the connection assemblies 20 and 20' are mirror images, their respective potential $X_1$ rotations will cancel each other out, preventing collapse if the distal ends 26 of the legs 24 are fixed in the lamp (not depicted).

Figure 5:
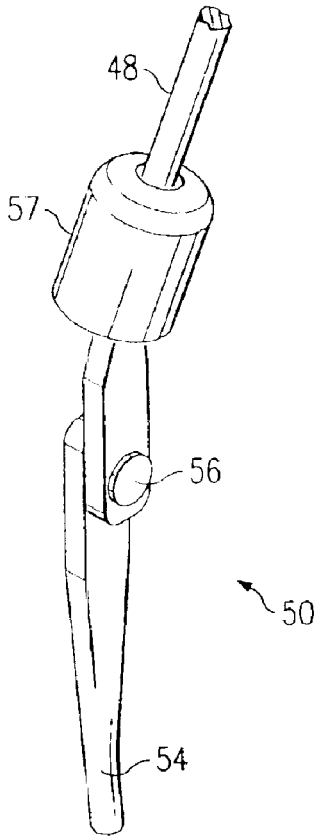
FIG. 5 is a partial top perspective view of an alternative embodiment of a connection assembly.

It is understood that a variety of alternative connection assemblies are contemplated by this disclosure. For example, and referring now to FIG. 5, a collapsible harp substantially similar in all respects to the harp 10 of FIGS. 1–4 other than those features described below, has a leg 48 substantially similar to the leg 18 of the previously described embodiment with the exception of its distal end. As will now be described, the distal portion of the leg 48 forms a portion of a connection assembly 50.

The leg 48 is connected to another leg 54, substantially similar to the leg 24 of the previously described embodiment with the exception of its proximal end. The connection assembly 50 includes a swivel pin 56 to pivotally attach the legs 48 and 54. A securing sleeve 57 is slidably disposed to secure the legs 48 and 54 in the extended position from movement relative to each other, and prevent the harp from collapsing. The securing sleeve 57 can be moved away from the swivel pin 56 to allow the legs 48 and 54 to pivot, thus allowing the harp to collapse.

Figure 6:
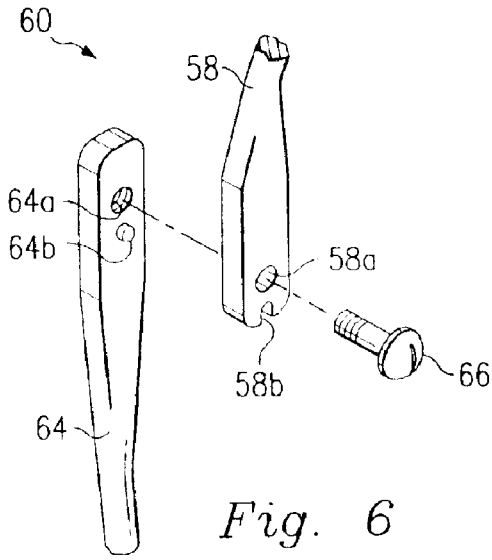
FIG. 6 is an exploded view of another alternative embodiment of a connection assembly.

In another alternative embodiment, and referring now to FIG. 6, a collapsible harp substantially similar in all respects to the harp 10 of FIGS. 1–4 other than those features described below, has a leg 58, substantially similar to the leg 18 of the first described embodiment with the exception of its distal end. The leg 58 has a bore 58*a* and a notch 58*b*, for reasons to be described. As will now be described, the distal portion of the leg 58 forms a portion of a connection assembly 60.

The leg 58 is connected to another leg 64, substantially similar to the leg 24 of the first described embodiment with the exception of its proximal end, which has a bore 64*a* and a pin 64*b*. The bores 58*a* and 64*a* of the respective legs 58 and 64 receive a screw 66 to connect the legs. In one embodiment, the screw enables the legs 58 and 64 to move pivotally with respect to each other. When engaged, such as by sufficiently tightening the screw 66, the notch 58*b* and the pin 64*b* prevent pivotal motion between the legs 58 and 64.

Figure 7:
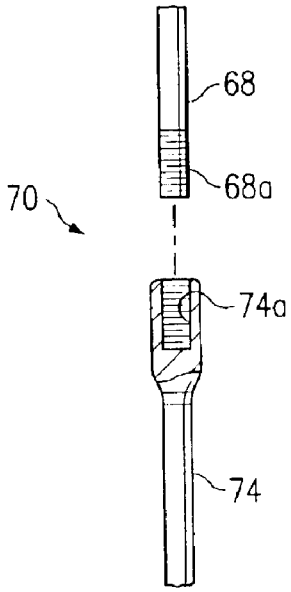
FIG. 7 is a partial side view with a portion broken away of yet another alternative embodiment of a connection assembly.

In another alternative embodiment, and referring now to FIG. 7, a collapsible harp substantially similar in all respects to the harp 10 of FIGS. 1–4 other than those features described below, has a leg 68, substantially similar to the leg 18 of the first described embodiment with the exception of its distal end. A threaded portion 68*a* is disposed on the distal end of the leg 68, for reasons to be described. As will now be described, the distal portion of the leg 68 forms a portion of a connection assembly 70.

The leg 68 is connected to another leg 74, substantially similar to the leg 24 of the first described embodiment with the exception of its proximal end, which has a threaded receiver 74*a* for receiving the threaded portion 68*a* for connecting the legs. The legs 68 and 74 are secured from movement relative to each other when the threaded portion 68*a* is engaged in the threaded receiver 74*a*, thus preventing the harp from collapsing in the extended position.

Figure 8:
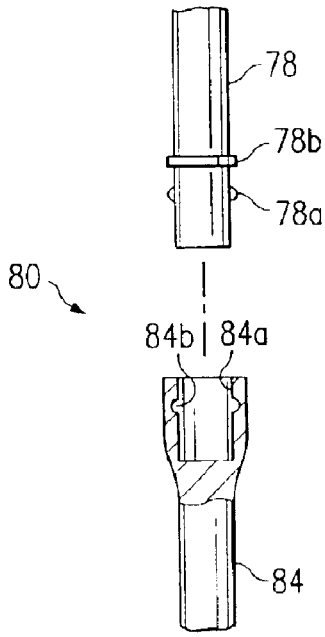
FIG. 8 is a partial side view with a portion broken away of yet another alternative embodiment of a connection assembly.

In another alternative embodiment, and referring now to FIG. 8, a collapsible harp substantially similar in all respects to the harp 10 of FIGS. 1–4 other than those features described below, has a leg 78, substantially similar to the leg 18 of the first described embodiment with the exception of its distal end. A pair of spring-like extrusions 78*a* are disposed on the distal end of the leg 78, for reasons to be described, as is a stop 78*b*. As will now be described, the distal portion of the leg 78 forms a portion of a connection assembly 80.

The leg 78 is connected to another leg 84, substantially similar to the leg 24 of the first described embodiment with the exception of its proximal end, which has a bore 84*a*, for receiving the distal end of the leg 78. A groove 84*b* is disposed in the bore 84*a* for receiving the extrusions 78*a* of the leg 78, defining a pressure fit snap connection. The legs 78 and 84 are secured from movement relative to each other when the extrusions 78*a* are engaged in the receptacles 84*a*, thus preventing the harp from collapsing in the extended position. It is understood that a variety of other conventional snap connections may be used.

While the invention has been particularly shown and described with reference to the preferred embodiment thereof, it will be understood by those skilled in the art that various changes in form and detail may be made therein without departing from the spirit and scope of the invention. Therefore, the claims should be interpreted in a broad manner, consistent with the present invention.

What is claimed is:

1. A collapsible lamp harp, comprising:

a first leg; and a second leg connected to the first leg via a swivel pin, thereby allowing the legs to move between an extended and a collapsed position, wherein the first leg comprises a first groove to receive a first catch formed on the second leg.

2. The lamp harp of claim 1 wherein the first leg comprises a second groove to receive a second catch formed on the second leg.

3. The lamp harp of claim 2 wherein the second groove is located on the opposite side of the first leg from the first groove.

4. The lamp harp of claim 2 wherein the second catch is located on the same side of the second leg as the first catch.

5. The lamp harp of claim 4 further comprising another first and second leg connected by a connection assembly disposed in a mirror image orientation to the first connection assembly.

6. The lamp harp of claim 5 wherein the first and second connection assemblies rotate in opposite directions, thereby preventing collapse from the extended position when the second legs are secured.

7. A collapsible lamp harp, comprising:

a first leg; and a second leg connected to the first leg via a snap connection, thereby allowing the legs to move between an extended and a collapsed position.

8. The lamp harp of claim 7 further comprising a stop.

9. A collapsible lamp harp, comprising:

a first leg; and a second leg connected to the first leg via a screw, thereby allowing the legs to move between an extended and a collapsed position, further comprising a pin and notch for cooperating to prevent pivotal motion between the first and second legs when the screw is tightened.

10. A collapsible lamp harp, comprising:

a first leg; and a second leg connected to the first leg via a threaded portion and corresponding receptacle, thereby allowing the legs to move between an extended and a collapsed position.

* * * * *